United States Patent [19]

Jones

[11] Patent Number: 4,901,687

[45] Date of Patent: Feb. 20, 1990

[54] SPARK PLUG INDEX PLATE FOR COMBUSTION ENGINES

[76] Inventor: Charles E. Jones, Route 611 & Annawanda Rd., Ottsville, Pa. 18942

[21] Appl. No.: 224,789

[22] Filed: Jul. 27, 1988

[51] Int. Cl.[4] ..... F02P 15/00

[52] U.S. Cl. ..... 123/169 R; 123/198 R

[58] Field of Search ..... 123/169 R, 169 EC, 169 EL, 123/198 R; 313/118, 125; 324/400

[56] References Cited

U.S. PATENT DOCUMENTS 1,383,476 7/1921 Marquardt ..... 324/400

*Primary Examiner*—Tony M. Argenbright

*Attorney, Agent, or Firm*—R. Ward Church

[57] ABSTRACT

A process and device for indexing and storing electrode oriented spark plugs for use in internal combustion engines where the ground electrode position is critical to engine performance.

8 Claims, 1 Drawing Sheet

SPARK PLUG INDEX PLATE FOR COMBUSTION ENGINES

BACKGROUND OF THE INVENTION

The present invention relates to the field of spark plug containing engines. it deals with orienting the spark plug ground electrode in both flat and dome shaped piston engines to optimize performance and/or prevent the piston from hitting the ground electrode.

In dome shaped piston engines, the spark plug located near the edge of the cylinder must be oriented so that its ground electrode extends substantially away from the center of the cylinder, leaving the most space between the spark plug and top of the piston when the piston is at top-dead-center. Hence, such orientation prevents the piston from engaging the spark plug ground electrode at top-dead-center and either causing electrode damage or the plug gap to be varied. Top-Dead-Center "T-D-C" is that position of the piston when it extends farthest into the cylinder.

In the case of a flat piston engine, to improve efficiency, for example, the ground electrode should be pointed toward the center of the cylinder when the spark plug is tightly secured in its mooring in the cylinder head. Tests have indicated that engine efficiency has increased as much as 10 percent by such orientation. It is believed that the closer that the spark is in an unobstructed way to the intake valve the more efficient the engine appears to be.

Generally, orientation of each spark plug ground electrode, to obtain the aforementioned benefits, is had by trail and error. It is understood, of course, if each plug and each plug receiving hold were made standard with the same starting thread orientation trial and error orientation would not be necessary. However, the obverse is true. Electrode orientation in a domed shaped piston engine is accomplished, for example, by marking plural spark plugs on the exterior thereof with a "Magic marker" to show the direction in which the ground electrode points. Then each plug is threaded into a cylinder and tightened therein until one is found whereby its ground electrode points away from the center of the cylinder at approximately 90 degrees. Each cylinder of the engine is successively fitted with an appropriate spark plug in this manner. In the case of a flat piston engine this same procedure is performed except that the spark plug ground electrode for a respective cylinder must point toward the center of the cylinder and toward the valves.

The above technique of ground electrode spark plug orientation was and still is adequate, however, it is time consuming and one cannot store extra plugs without confusion. Some way has been needed to categorize or mate the plug for its respective cylinder. This need is met, in part, by using a threaded disk in which the plug is threadably inserted. Plural disks are used for plural cylinders. However, the disks can be lost and misplaced and the plug can be only hand tightened in the hole and thereby create inventory problems. In the case of an emergency whereby the matched plug is immediately needed, preparation error and loss of disks cannot be permitted. Hence, a long felt need has existed for a device and process whereby plural substitute plugs can be stored, and, inventoried at a glance.

SUMMARY OF THE INVENTION

Briefly stated, my invention, is a new process and device which pre-orients and indexes each spark plug for a respective cylinder for an entire engine. The device comprises a support means or plate assembly for indexing and storing all the plugs for a specific engine for ready access and use. My invention comprises such a device and a process of using same. In short, plural spark plugs are provided in moorings which are provided in cylinder indexing and firing order. Each mooring or spark plug receiving means is indexed and identified to a designated cylinder by the firing order of an engine so that orientation trials can be carried out on the plate moorings until all mooring or receiving means are filled.

OBJECTS OF THE INVENTION

The principle object of my invention is to provide a device for the proper indexing and orientation of spark plug electrodes in an engine.

Another object of my invention is to provide a process for the orientation and indexing of spark plug ground electrodes in an engine.

Still another object of my invention is to provide a process and device of and for the storage of spark plugs for ready replacement in an engine.

Another still object of my invention is to provide a device and process of orienting indexing, storing, and inventorying spark plugs for an engine preparation to use.

Other objects and advantages of my invention will be more apparent from the drawings and detailed description to follow.

DESCRIPTION OF THE PREFERRED EMBODIMENT

Figure 1:
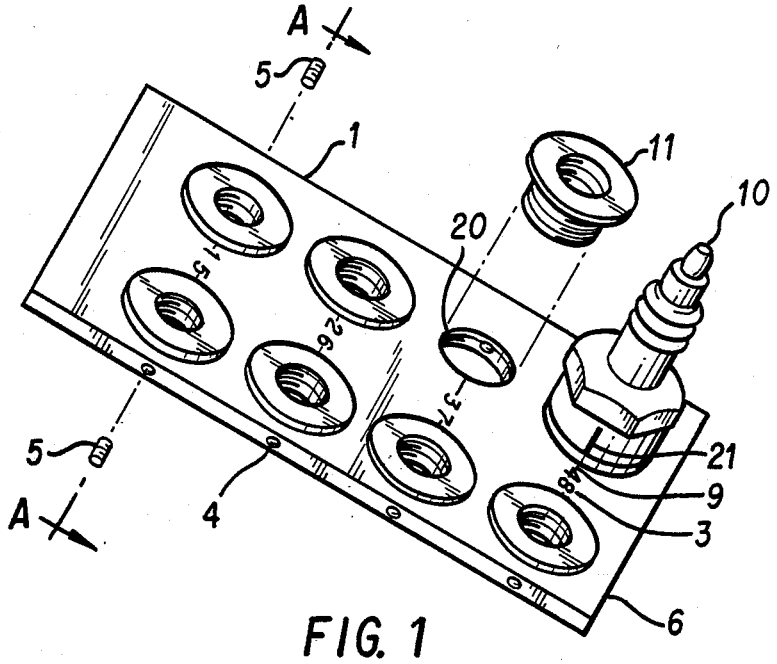
FIG. 1 depicts my invention with one spark plug disposed therein.

Referring to FIG. 1, I show my spark plug indexing and orientation device made up of plate 6 with spark plug receiving means or mooring means thread 7, or, insert 11 with thread 7 and flange 12. Orientation of plate 6 to the engine is designated, for example, by the numbers 3 representing the engine cylinders by its firing order. Orientation of plate 6 to the engine is designated, for example, by the numbers 3 representing the engine cylinders by its firing order. Orientation of the ground electrode on plate 6 is represented by number 9. Spark plug 10 is shown disposed on plate 6 into thread 7.

Figure 2:
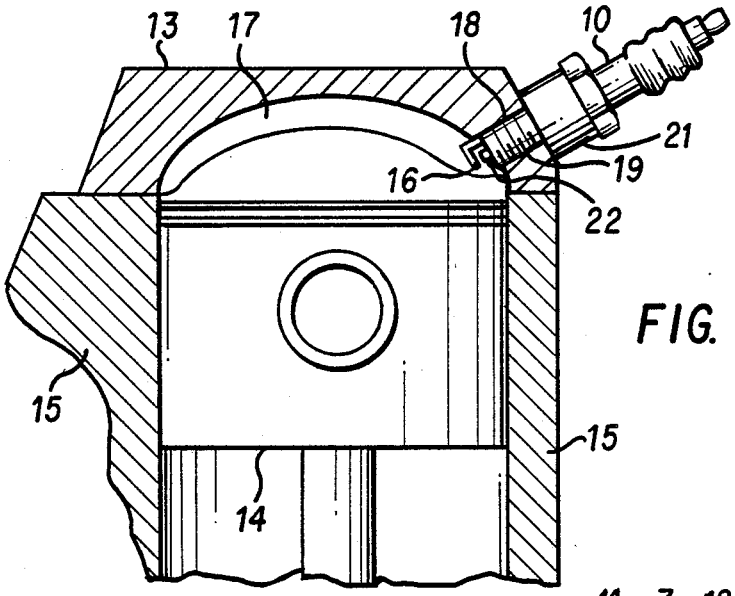
FIG. 2 depicts an engine cross-section showing a dome piston and the spark plug oriented to prevent the piston from engaging it.

FIG. 2, is a typical cross-section of engine 2 with cylinder block 15 having cylinder head 13 disposed thereon. Spark plug 10 with ground electrode 16 disposed away from the center of the firing chamber 17 is tightly secured into head 13 by plug thread 18 into cylinder head thread 19.

Figure 3:
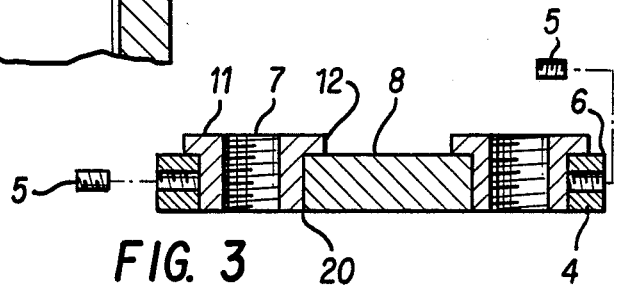
FIG. 3 is a cross-section of FIG. 1 at A—A.

FIG. 3 is plate section 3 at A—A of FIG. 1. Here plug holding means or thread 7 is disposed in insert 11 having flange 12. Insert 11 is rotatable in aperture 20 and secured therein by screw 5 threadable tightened in thread 4. Insert 11 is shown snugged to surface 8 of plate 6 by screw 5 in thread 4.

USE OF MY DEVICE

Referring to FIG. 1, plate 6 has plural spark plug moorings or holding means or threaded apertures 20. Each one is designated to receive a spark plug 10, though only one is shown. Each thread 7 is pre-designated or indexed by firing order number to hold spark plug 10 for a specified cylinder. For example, if plate 6 were used to hold the plugs of an 8 cylinder engine, one could let the apertures represent the cylinders as numbered by the manufacturers firing order of 1–8. Hence number 6A would be inscribed 1–8 on plate 6, if desired.

In use, spark plug 10 with ground electrode 16, as shown in FIG. 2, is removed from head 13. A mark 21 is made on the porcelain or nut portion of spark plug 10 as by a marking pen, showing the direction ground electrode 16 points towards center electrode 22. Once removed from cylinder head 13 spark plug 10 is screwed tightly into thread 7 of plate 6 as shown in FIG. 1. The mark 21 is then aligned with mark 9 of plate 6, as shown by rotating insert 11 in aperture 20. This same procedure is repeated from cylinder spark plug to cylinder spark plug until all the insert 11 of plate 6 are oriented and rotatably secured. Of course, each plug is returned to its respective cylinder thereafter because now the insert 11 thread substantially coincides with that of its respective cylinder so that one can merely try numerous plugs in respective threads 7 until an electrode 16 is found to align with each mark 9 of each aperture 20. Once all 8 spark plugs are found, a second set of spare plugs is ready for rapid and orderly replacement. One can now readily see the import of my invention. All plugs are already indexed to fit into designated cylinders and chosen for appropriate ground electrode radial orientation, thereby being threadably secured to the plate so loss and inventorying are no longer a problem. When choosing suitable spark plugs for a specific cylinder radial variation to plus or minus 60 degrees has been found tolerable to still render the appropriate orientation.

Materials of which my device is made can vary considerably. Plate 6 can be made of any metal or plastic so long as my objectives are accomplished. In the instant embodiment plate 6 is aluminum, insert 11 is brass, and screw 5 is steel, however, other plastics and non-plastics could be used as well. Insert 11 has flange 12, however, it is within the preview to eliminate it if desired. Also, it is understood to merely thread apertures 11 and eliminate one or both marks 9 on plate 6 and place a mark 9 on plate 6 wherever mark 22 so occurs as each spark plug 10 is successively inserted to initially establish plate 6 electrode 16 orientation. In the latter case wherein threads 7 are directly made in apertures 20 it is understood that each mark 9 with a cylinder numeral would be randomly located about its respective aperture and not in order as when inserts 11 are used. It is also understood that the invention can be used for engines of various kinds and a various number of cylinders. Support means or plate 6 need only have as many apertures 20 as cylinders, though it can have more. The importance being that each cylinder have its mooring. Support means or plate 6 can be made by casting, molding, forging, pressing or cutting same from stock. Plug moorings need not extend through the plate. Inserts 11 can be in the form of tubes threaded plates, nipples, or washers. Other modifications and changes will occur to one skilled in the art without departing from the invention.

What is claimed is:

1. A device for the orientation, indexing and storage of spark plugs for an internal combustion engine comprising:

a support member and plural spark plug holding means for indexing and ground electrode orienting of said spark plugs to cylinders of said engine.

2. The invention of claim 1 wherein said holding means comprises screw threads to receive a mating thread spark plug.

3. The invention of claim 2 wherein said means comprises an insert with threads therein.

4. The invention of claim 2 wherein said support member is a plate with apertures for said means.

5. The invention of claim 4 wherein said means are rotatable fixable inserts.

6. The process of providing plural replacement spark plugs for a combustion engine wherein said plugs must each have rotational ground electrode orientation in said engine, comprising the steps of:

providing an engine spark plug plate means having at least as many threaded and oriented spark plug receiving means as engine cylinders, with said means indexed to coincide with each cylinder;

successively threading spark plugs into each said means until a plug fits snuggly and meets the ground electrode orientation for that cylinder.

7. The process of claim 6 wherein said receiving means is oriented by rotational reference.

8. The process of claim 7 wherein said receiving means is an insert which is secured into proper orientation by screw means.

* * * * *